US012584248B2

(12) United States Patent
Kamijo et al.

(10) Patent No.: US 12,584,248 B2
(45) Date of Patent: Mar. 24, 2026

(54) POLYAMIDE 46 MULTIFILAMENT

(71) Applicant: Toray Industries, Inc, Tokyo (JP)

(72) Inventors: Taichi Kamijo, Okazaki (JP); Hisao Shigeno, Okazaki (JP); Kazushi Minai, Okazaki (JP)

(73) Assignee: Toray Industries, Inc., Tokyo (JP)

( * ) Notice: Subject to any disclaimer, the term of this patent is extended or adjusted under 35 U.S.C. 154(b) by 320 days.

(21) Appl. No.: 17/799,153

(22) PCT Filed: Mar. 9, 2021

(86) PCT No.: PCT/JP2021/009132

§ 371 (c)(1),
(2) Date: Aug. 11, 2022

(87) PCT Pub. No.: WO2021/182429

PCT Pub. Date: Sep. 16, 2021

(65) Prior Publication Data

US 2023/0076788 A1 Mar. 9, 2023

(30) Foreign Application Priority Data

Mar. 13, 2020 (JP) ..... 2020-043988

(51) Int. Cl.

| | |
|---|---|
| ***D01F 6/60*** | (2006.01) |
| ***D01D 5/12*** | (2006.01) |
| ***D02J 1/22*** | (2006.01) |

(52) U.S. Cl.

CPC ..... *D01F 6/60* (2013.01); *D01D 5/12* (2013.01); *D02J 1/22* (2013.01); *D10B 2331/02* (2013.01); *D10B 2401/04* (2013.01)

(58) Field of Classification Search

None

See application file for complete search history.

(56) References Cited

U.S. PATENT DOCUMENTS

| | | | | |
|---|---|---|---|---|
| 2005/0089654 | A1* | 4/2005 | Yu | B60R 21/235 428/34.1 |
| 2011/0036447 | A1* | 2/2011 | Horiguchi | D02G 3/446 57/200 |
| 2015/0218731 | A1 | 8/2015 | Mitadera et al. | |

FOREIGN PATENT DOCUMENTS

| | | | |
|---|---|---|---|
| CA | 1314675 | * | 3/2023 |
| EP | 0 381 281 | A2 | 8/1990 |
| JP | 50-7169 | | 3/1975 |
| JP | 59-88942 | | 5/1984 |

(Continued)

OTHER PUBLICATIONS

Machine Translation of JPS5976914 (Year: 1984).*

The International Search Report dated Jun. 1, 2021, attached to the PCT Application as published under No. WO 2021/182429 A1.

*Primary Examiner* — Shawn Mckinnon

(74) *Attorney, Agent, or Firm* — DLA Piper LLP (US)

(57) ABSTRACT

A polyamide 46 multifilament has a strength of 6.0 to 9.0 cN/dtex and an elongation at break of 15% to 30%, an elongation rate (E'10) of less than 2.5% after heat treatment at 120° C. for 24 hours and subsequent stretching performed 10 times in a room temperature environment, and the difference (E'10−E'1) between the elongation rate (E'1) of the heat-treated fiber measured after stretching it once in a room temperature environment and its elongation rate (E'10) measured after stretching it ten times in a room temperature environment is less than 0.60%.

1 Claim, 1 Drawing Sheet

(56) References Cited

FOREIGN PATENT DOCUMENTS

| | | |
|---|---|---|
| JP | S59-76914 | 5/1984 |
| JP | S59-88910 | 5/1984 |
| JP | H1-168914 | 7/1989 |
| JP | 2-210018 | 8/1990 |
| JP | 2002-249943 | 9/2002 |
| JP | 2009-243030 | 10/2009 |
| JP | 2010-100988 | 5/2010 |
| JP | 2014-37642 | 2/2014 |

* cited by examiner

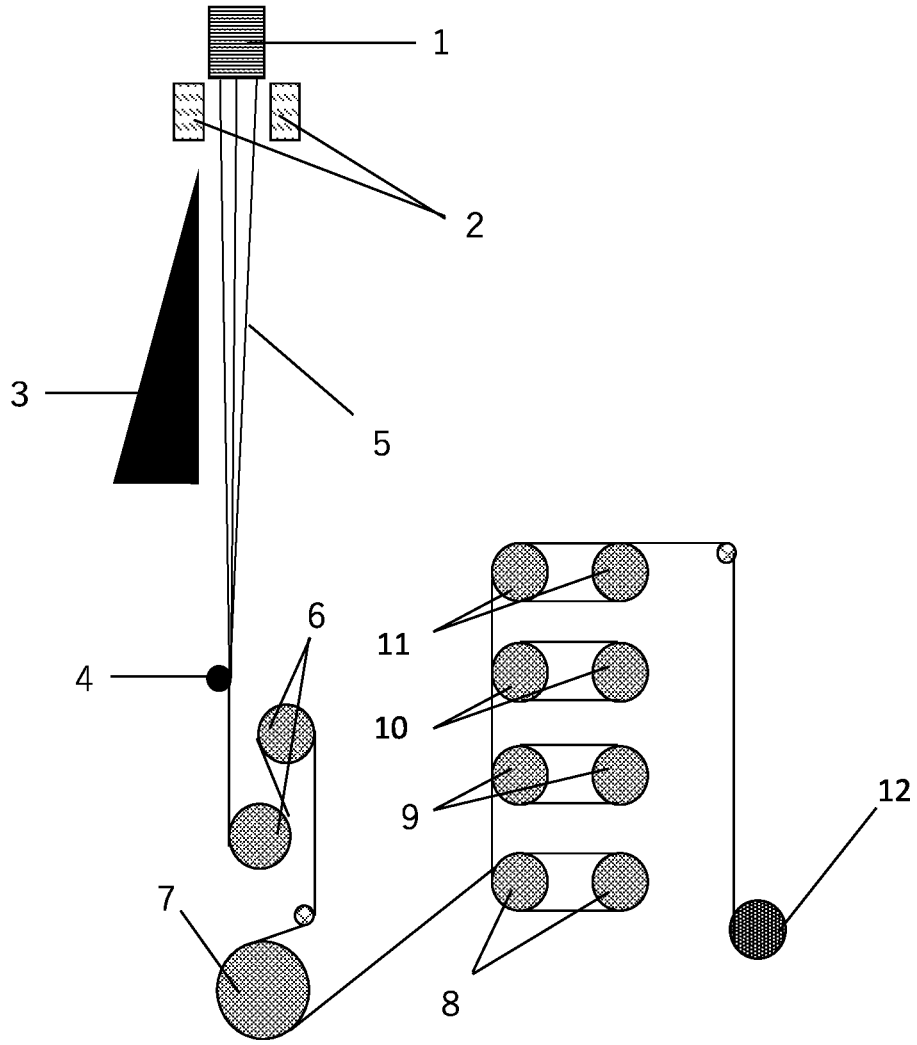
1
2
3
5
6
4
11
10
9
12
7
8

POLYAMIDE 46 MULTIFILAMENT

TECHNICAL FIELD

This disclosure relates to a polyamide 46 multifilament.

BACKGROUND

A multifilament yarn made of an aliphatic polyamide, as compared with multifilament yarns made of other materials, is a high-strength polyamide multifilament yarn having excellent properties such as high strength and high elongation.

Applications of high-strength polyamide multifilament yarns include industrial belt cords. In particular, polyamide 66 has been frequently used as material for belt cords because it is inexpensive in spite of having high melting points and high strength among other polyamides. Compared to polyamide 66, polyamide 46 has a still higher melting point and higher heat resistance to realize very high thermal dimensional stability. Accordingly, it serves as a suitable material for belt cords, and techniques for achieving increased strength by improving spinning and drawing conditions have been disclosed (Japanese Unexamined Patent Publication (Kokai) No. S59-88910). Other techniques for enhancing thermal dimensional stability have also been disclosed (Japanese Unexamined Patent Publications (Kokai) Nos. S59-76914 and H1-168914), and there have been other techniques intended to provide polyamide 46 materials having further enhanced characteristics suitable for belt cord production. However, although some techniques for producing polyamide 46 multifilament yarns having improved strength and thermal dimensional stability have been reported so far, there have been few disclosed techniques that are intended to improve their stretchability and, furthermore, there have been no reports so far that propose a technique that can improve stretchability while maintaining high thermal dimensional stability, that is, a technique that can realize both high thermal dimensional stability and high stretchability.

Stretchability is a useful property not only for producing belt cords but also for producing other products such as sewing threads, and if stretchability at high temperatures can be realized, in particular, such products are expected to serve for various applications in a wider range of fields. Method disclosed so far for producing stretchable polyamide multifilament yarns include, for example, the technique of adopting a semi-drawing polyamide multifilament as sheath yarn and another polyamide multifilament as core yarn and subjecting them to Taslan processing (Japanese Unexamined Patent Publication (Kokai) No. 2002-249943). However, the use of the conventional stretchability development technique leads to a raw yarn design that impairs strength, and it is difficult to apply it to industrial applications that require high strength.

Thus, the conventional technology fails in producing a polyamide 46 multifilament yarn that has all high strength, high thermal dimensional stability, and high stretchability.

It could therefore be helpful to provide a polyamide 46 multifilament yarn that has all high strength, high thermal dimensional stability, and high stretchability.

SUMMARY

We thus provide a polyamide monofilament having the following:

A polyamide 46 multifilament characterized in that it has a strength of 6.0 to 9.0 cN/dtex and an elongation at break of 15% to 30%, that it has an elongation rate (E'10) of less than 2.5% after heat treatment at 120° C. for 24 hours and subsequent stretching performed 10 times in a room temperature environment, and that the difference (E'10–E'1) between the elongation rate (E'1) of the heat-treated fiber measured after stretching it once in a room temperature environment and its elongation rate (E'10) measured after stretching it ten times in a room temperature environment is less than 0.60%.

It is preferable that the difference (E10-1) between the elongation rate (E1) measured after stretching it once in a room temperature environment and the elongation rate (E10) measured after stretching it ten times in a room temperature environment is less than 0.70% and that it has a heat shrinkage rate at 120° C. of 0.5% to 2.0%, a sulfuric acid relative viscosity of 3.0 to 5.0, and a total fineness of 300 dtex to 2,300 dtex.

The polyamide 46 multifilament is produced by melt-spinning polyamide 46 and subjecting the undrawn yarn to multi-step drawing, wherein the multi-step drawing contains at least a first step drawing and a final step drawing, with the final step drawing being performed to a draw ratio of 1.00 to 1.10. In addition, when the polyamide 46 multifilament is produced by melt spinning, the melting is performed in a vacuum.

We thus provide a polyamide 46 multifilament having high strength, high thermal dimensional stability, and high stretchability simultaneously.

BRIEF DESCRIPTION OF THE DRAWING

The FIGURE is a schematic diagram of a production process (melting step is omitted) for producing the polyamide 46 multifilament.

EXPLANATION OF NUMERALS

1: spinneret
2: heating hood
3: cross flow cooling device
4: oil supply device
5: yarn
6: take-up rollers (1FR)
7: yarn feeding roller (2FR)
8: first drawing rollers (1DR)
9: second drawing rollers (2DR)
10: third drawing rollers (3DR)
11: relaxing rollers (RR)
12: winder

DETAILED DESCRIPTION

Our polyamide 46 multifilament is described below.

Our polyamide 46 multifilament is made of a polyamide resin. The polyamide resin is preferably a polyamide resin that contains polyamide 46 as main component. In particular, it is more preferable that polyamide 46 account for 98% by mass or more of the total mass of the polyamide resin excluding the mass of the additives described later and it is still more preferable that it is purely made of polyamide 46. It is also possible to use a copolymer of polyamide 46 with another polyamide, and useful polyamides for the copolymerization include polyamide 6, polyamide 66, polyamide 610, and polyamide 612. Furthermore, it may be a mixture of polyamide 46 and another polyamide. The use of a polyamide 46 resin having a high melting point as main component serves to produce a multifilament having high heat resistance.

The polyamide resin preferably contains heat-resistant agents including copper compounds such as conventionally known inorganic and organic copper salts and metal copper, amine compounds, mercapto compounds, phosphorus compounds, and hindered phenol compounds, which account for 250 to 7,000 ppm, preferably 500 to 5,000 ppm. These may be used singly or as a combination of two or more thereof. If these heat-resistant agents account for less than 250 ppm, they can work only to a limited degree in suppressing the thermal deterioration of the polymers, leading to filaments having decreased strength and elongation in high temperature. On the other hand, if a heat resistant agent is added to more than 7,000 ppm, the resulting fibers tend to be low in strength and elongation.

The polyamide 46 to use as raw material preferably has a sulfuric acid relative viscosity of 3.0 to 5.0, more preferably 3.5 to 5.0. If the sulfuric acid relative viscosity is larger than the above range, it tends to lead to a decrease in spinning ability and cause frequent yarn breakage and fluffing during drawing process. If the sulfuric acid relative viscosity is less than 3.5, furthermore, it means that the molecular chains of the polyamide are so short that it will fail to develop a high stretchability and thermal dimensional stability required for the above applications. The sulfuric acid relative viscosity was measured according to the method described in the EXAMPLES section.

The polyamide 46 multifilament preferably has a fineness of 300 to 2,300 dtex, more preferably 400 to 1,700 dtex. If the fineness is less than 200 dtex, the fibers are so small in fineness that fluffing will be more likely to occur during thermal drawing of the multifilament that is performed after the melt spinning step. On the other hand, if the fineness is more than 2,300 dtex, not only it will be difficult to use it, for example, as a sewing yarn, but also it will sometimes lead to belts with poor strength and durability because the uniformity of cooling after melt-spinning is so low that only low-quality yarn can be obtained.

The polyamide 46 multifilament preferably includes 30 to 350 monofilaments, more preferably 50 to 250 monofilaments. If the number of monofilaments is less than this range, the fineness of the monofilaments tends to be so large that the cooling efficiency in the melt spinning process will decrease, possibly leading to a multifilament with poor flexibility. On the other hand, if the number is more than the above range, the monofilament fineness tends to be so small that fluffing will occur easily.

It is essential that the polyamide 46 multifilament have a strength of 6.0 to 9.0 cN/dtex, preferably 7.0 to 9.0 cN/dtex. A strength in this range is also a property value that a polyamide multifilament is required to have in many uses where it is applied to various products, and we found that it is essential for a polyamide 46 multifilament to have a strength in range when it is required to have both a high thermal dimensional stability and a high stretchability. The strength was measured according to the method described in the EXAMPLES section.

It is essential that the polyamide 46 multifilament have an elongation at break of 15% to 30%, preferably 18% to 30%. If it is in this range, the resulting belt will be able to absorb impact as it extends or contracts when a load is applied, and accordingly, the belt can maintain durability. The elongation was measured according to the method described in the EXAMPLES section.

There are no specific limitations on the cross-sectional shape of the monofilaments in the polyamide 46 multifilament. The adoptable cross-sectional shapes include not only circular, but also other various shapes such as flattened, polygonal, Y-shaped, X-shaped, and other irregular shapes, as well as hollow. It may be a commingled one containing two or more types of monofilaments having different cross-sectional shapes.

It is preferable that the difference (E10-E1) between the elongation rate (E1) measured after stretching it once in a room temperature environment and the elongation rate (E10) measured after stretching it ten times in a room temperature environment be less than 0.70%. It is more preferably less than 0.60%. If this range is exceeded, it will suffer a large hysteresis loss when applied to a belt cord and, accordingly, the belt will deteriorate in tension as it is used for a prolonged period and fail to work as a product for medium to long term use. The procedure for the repeated tensile test and the calculation method for the elongation rate are described in the EXAMPLES section.

It is essential that the elongation rate (E'10) measured after treating it at 120° C. for 24 hours and then stretching it ten times in a room temperature environment be less than 2.5%, preferably less than 2.0%. Furthermore, it is essential that the difference (E'10−E'1) between the elongation rate (E'1) measured after stretching a heat-treated fiber once in a room temperature environment and the elongation rate (E'10) measured after stretching it ten times be less than 0.60%, preferably less than 0.50%. When a belt is in use, the belt, as well as the cord that includes it, will suffer a temperature increase due to such a load, friction, and the usage environment. Therefore, if the difference in elongation rate is too large and exceeds the above limit, the belt will deteriorate in tension while being used in a temperature range from room temperature to a high temperature. The procedures for the 24-hour treatment at 120° C. and repeated tensile test and the calculation method for the elongation rate are described in the EXAMPLES section.

Furthermore, it is preferable that the heat shrinkage rate of the polyamide 46 multifilament at 120° C. be preferably 0.5% to 2.0%, more preferably 0.5% to 1.7%. If heat shrinkage rate is less than the above range, tension will not be developed as the temperature rises due to friction while the belt is driven, and the multifilament may lose its stretchability. On the other hand, if the heat shrinkage range exceeds the above range, it may lead to a decrease in thermal dimensional stability.

Described below is an example of the production method for a polyamide 46 multifilament.

It is preferable that the polyamide 46 multifilament be produced by melt spinning, and as described above, it is preferable that the nylon 46 resin used for the melt spinning process have a sulfuric acid relative viscosity of 3.0 to 5.0, more preferably 3.5 to 5.0. If it is in this range, it serves to produce a high-strength nylon 46 multifilament stably while maintaining a favorable degree of spinning ability.

A typical schematic diagram of the production method for a polyamide 46 multifilament is shown in the FIGURE (the melting step is not included).

A polyamide 46 resin as described above is melted, mixing, and spinning in an extruder type spinning machine, wherein melting is preferably performed in a vacuum environment. For the vacuum environment, the pressure at the resin supply port of the extruder is preferably less than 5 kPa, more preferably less than 3 kPa. Unlike other aliphatic polyamides, which tend to thicken and form higher molecular weight polymers when melted, polyamide 46 has the property of being decomposed into lower molecular weight polymers in the melting step. The decomposition mechanisms can be roughly categorized into thermal decomposition, oxidative decomposition, and hydrolysis. If melting is performed in a vacuum, water and oxygen in air are eliminated, and decomposition occurs only through the thermal decomposition mechanism. Thus, the decomposition of the resin can be suppressed. Such suppression of decomposition in the melting step, the molecular weight of the resin constituting the multifilament can be maintained at a high level, thereby producing a highly crystallized polyamide 46 multifilament and hence a product having both stretchability and thermal dimensional stability.

The spinning temperature is set to a level higher by 10° C. to 50° C. than the melting point of the polymer, and melt spinning is performed from a spinneret 1 that has a plurality of, preferably 30 to 350, and more preferably 50 to 250 holes. Preferably, the space ranging from 5 to 300 cm below the bottom of the spinneret is surrounded by a heating hood 2 to allow the undrawn yarn to pass through a high temperature atmosphere maintained within −30° C. to +30° C. of the melting point. The high temperature atmosphere through which the yarn passes is more preferably maintained within −15° C. to +15° C. of the melting point. The undrawn yarn is not cooled immediately but cooled slowly as it passes through the high temperature atmosphere surrounded by a heating hood, and this allows the molecular orientation of the undrawn polyamide 46 to be relaxed and serves to increase the uniformity of molecular orientation among the monofilaments, making it possible to produce polyamide 46 filaments having higher strength. On the other hand, if the yarn is immediately cooled instead of passing through a high temperature atmosphere, the resulting unstretched yarn will have a higher degree of orientation and the monofilaments will have a larger variation in the degree of orientation. If such an unstretched yarn is hot-stretched, it may possibly result in a failure in producing a high-strength polyamide 46 multifilament.

The undrawn yarn that has passed the above step is cooled and solidified by blowing air at 10° C. to 80° C., preferably 10° C. to 50° C., from a cross-flow cooling device 3. The use of cooling air at less than 10° C. is not preferable because it requires a large cooling device. On the other hand, if the temperature of cooling air is more than 80° C., a large volume of air will be required and the monofilaments will undergo large sway to cause collisions among monofilaments, leading to a deterioration in yarn productivity.

It is preferable that the undrawn yarn that has been cooled and solidified be subsequently stretched in multiple step drawing process, particularly in two or three stages. A specific example of three step drawing setup is illustrated in the FIGURE, in which a cooled and solidified undrawn yarn is first provided with an oil agent from an oil supply device 4 and taken up by take-up rollers (1FR) 6. The take-up rollers are commonly unheated. Then, the yarn is sent to the yarn feeding roller (2FR) 7, the first draw rollers (1DR) 8, the second draw rollers (2DR) 9, the third draw rollers (3DR) 10, and the relaxation rollers (RR) 11 in this order. Thus, the yarn is heat-treated, stretched, and finally wound on a winder 12. The 2FR roller preferably has a mirror surface, and the 1DR, 2DR, 3DR, and RR rollers preferably have satin finished surfaces.

The first step drawing is performed between the 2FR roller and the 1DR rollers. The 2FR roller has a temperature (surface temperature of the roller) of 30° C. to 50° C. and the 1DR rollers have a temperature of 100° C. to 225° C. The second step drawing is performed between the 1DR rollers and the 2DR rollers. The 2DR rollers have a temperature (surface temperature of the rollers) of 150° C. to 230° C. The third step drawing is performed between the 2DR rollers and the 3DR rollers. The 3DR rollers have a temperature (surface temperature of the rollers) of 180° C. to 240° C.

For the production of the polyamide 46 multifilament, it is important for the draw ratio in the third-step drawing, that is, the final drawing step, to be 1.00 to 1.10. This draw ratio is preferably 1.00 to 1.05. Drawing under these conditions serves not only to increase the degree of crystallinity but also to maintain orientation in the amorphous region. In this way, it is possible to provide a multifilament having high strength, thermal dimensional stability, and high stretchability simultaneously. If the stretching ratio is larger than the above range, molecular chains in the amorphous region will be oriented to a higher degree, leading to deterioration in thermal dimensional stability. If significant fluffing occurs, the strength tends to deteriorate. If the stretching ratio is less than 1.00, the tension may decrease, possibly leading to significant yarn sway and difficulty in yarn production.

In this way, the polyamide 46 multifilament can be obtained.

EXAMPLES

Sulfuric Acid Relative Viscosity

A 1 g sample was dissolved in 100 ml of 98% sulfuric acid and measurement was performed at 25° C. using an Ostwald viscometer. Two measurements were taken and their average was adopted.

Fineness of Multifilament

Measurements were taken by according to JIS L1090 (1999).

Strength and Elongation at Break of Fiber

Measurements of tensile strength and elongation taken by the method specified in JIS L1013 (1999) were adopted as the strength and elongation of the sample. The measurement was performed using a Tensilon tensile tester manufactured by Orientec Co., Ltd. under the conditions of a test length of 250 mm and a tensile speed of 300 mm/min. Three measurements were taken from each sample and their average was calculated.

Elongation Rate After Repeated Tensile Test in Room Temperature Environment

A yarn sample with a length of 250 mm was held by chucks in a Tensilon tensile tester manufactured by Orientec Co., Ltd. in a 25° C. environment and pulled at a speed of 300 mm/min until a load of 2.0 cN/dtex was reached, and then the chucks were moved back at a speed of 300 mm/min to the original chuck-to-chuck distance. This cycle was repeated a specified number of times. In the repeated tensile test, the elongation percentage measured at the point where the load reached 0.1 cN/dtex in the last return path after the elongation path was repeated a specified number of times was adopted as the elongation rate after the repeated tensile test. More specifically, after the first elongation, the elongation percentage that the sample shows when the load reaches 0.1 cN/dtex as it returns to the original chuck-to-chuck distance is referred to as E1. The elongation-return cycle is repeated nine times additionally, and the elongation percentage the sample shows when the load reaches 0.1 cN/dtex as it returns to the original chuck-to-chuck distance in the final cycle is referred to as E10.

Treatment at 120° C. for 24 Hours

A fiber sample with a length of 250 mm was held by chucks in a Tensilon RTG-1250 tensile tester manufactured by A&D Company, Limited in a 25° C. environment and a TLF-3R/F/G-S high and low temperature environment tank manufactured by A&D Company, Limited was set to perform treatment at 120° C. for 24 hours.

Elongation Rate After Repeated Tensile Test in Room Temperature Environment After Treatment at 120° C. for 24 Hours A yarn was taken out of the high and low temperature environment tank, and a fiber sample with a length of 250 mm was subjected to a repeated tensile test in a 25° C. environment using an Tensilon RTG-1250 tensile tester manufactured by A&D Company, Limited in the same way as described in the section [Elongation rate after repeated tensile test in room temperature environment], followed by calculating the elongation rate.

Heat Shrinkage Rate at 120° C.

A fiber sample with a length of 250 mm was treated at 120° C. for 2 minutes using TST2 manufactured by Lenzing Instruments and the fiber shrinkage rate was determined before and after the treatment as follows: ({(length before treatment−length after treatment)/length before treatment)}×100(%)).

Yarn Productivity

Polyamide 46 was melt-spinning, and the resulting unstretched yarn was stretched in multiple stages, wherein it was stretched at least in the first stage stretching step and the final stretching step. In each example and comparative example given below, a yarn was produced according to this procedure and it was evaluated in terms of yarn breakage frequency and fluffing frequency as described below. Yarn breakage refers to a state in which the yarn is broken during its production, making it impossible to continue the production step.

A: The frequency of yarn breakage per hour is less than 0.1, and the frequency of fluffing in every 10,000 m is less than 1.

B: The frequency of yarn breakage per hour is 0.1 or more or the frequency of fluffing in every 10,000 m is 1 or more.

C: Yarn breakage occurs frequently and yarn sampling cannot be performed.

Example 1

Production Method for Polyamide 46 Multifilament

The production steps used is illustrated in the FIGURE.

A polyamide 46 resin with a sulfuric acid relative viscosity of 3.9 (Stanyl (registered trademark), melting point 292° C.) was melted at 305° C. in a vacuum using an extruder type spinning machine. The molten polymer was weighed in a gear pump so that the total fineness would be 940 dtex and sent to a spinning pack, in which it was filtered through a 20 μm nonwoven metal fabric filter and spun through a spinneret having 136 round holes. A heating hood with a heating hood length of 15 cm was installed 3 cm below the spinneret surface, and heat was supplied to control the atmosphere inside the hood at a temperature of 300° C., thereby allowing the undrawn yarn to pass through an atmosphere at 300° C. The temperature of the atmosphere inside the cylinder is the temperature of air measured at a point at the center of the length of the heating hood and 1 cm away from its inner wall.

A uniflow type chimney designed to blow air in one direction was attached immediately under the heating hood, and cold air at 20° C. was blown at a speed of 35 m/min to the yarn coming out of the heating hood to cool and solidify it, followed by applying an oil agent from an oil feeding device.

After receiving the oil, the undrawn yarn was sent to and taken up by the 1FR rollers rotating with a surface speed of 600 m/min, and it was then stretched to a total draw ratio of 4.70. The yarn taken up was immediately stretched, instead of once winding up, by 5% between the take-up rollers and the 2FR roller, and then subjected to the first-step drawing performed at a rotation speed ratio of 3.27, then the second-step drawing performed at a rotation speed ratio of 1.30, and finally the third-step drawing performed at a rotation speed ratio of 1.05, and wound up at a speed of 2,600 m/min. The 1FR and 2FR rollers had mirror-finished surfaces, and the 1DR, 2DR, 3DR, and RR rollers had satin-finished surfaces. The temperatures of the rollers were as follows: 1FR not heated, 2FR 80° C., 1DR 175° C., 2DR 180° C., 3DR 230° C., and RR 150° C. A nylon 46 multifilament was produced through these melt-spinning and drawing steps (Table 1).

Evaluations of its physical properties are summarized in Table 2.

Example 2

Except that the third-step drawing ratio (final draw ratio) was 1.00, the same procedure as in Example 1 was carried out.

Example 3

Except that the molten polymer was weighed in a gear pump in the melt spinning step so that the fineness would be 1,400 dtex and also that the spinneret used had 204 round holes, the same procedure as in Example 1 was carried out.

Example 4

Except that the molten polymer was weighed in a gear pump in the melt spinning step so that the fineness would be 470 dtex, that the spinneret used had 72 round holes, and that drawing was performed to a total draw ratio of 4.20, the same procedure as in Example 1 was carried out.

Example 5

Except that two-step drawing was performed and that the final draw ratio was 1.08, the same procedure as in Example 1 was carried out.

Comparative Example 1

Except that the final draw ratio was 1.25, the same procedure as in Example 1 was carried out.

Comparative Example 2

Except that the final draw ratio was 0.90, the same procedure as in Example 1 was carried out.

Comparative Example 3

Except that the melt spinning in the extruder type spinning machine was carried out under normal pressure, the same procedure as in Example 1 was carried out.

Comparative Example 4

Except that the molten polymer was weighed in a gear pump in the melt spinning step so that the fineness would be 235 dtex, the same procedure as in Example 4 was carried out.

Comparative Example 5

Except that polyamide 66 polymer having a sulfuric acid relative viscosity of 3.7 was melt-spun in a vacuum at 280° C. using an extruder type spinning machine, the same procedure as in Example 1 was carried out.

Comparative Example 6

Except that polyamide 6 polymer having a sulfuric acid relative viscosity of 3.7 was melt-spun in a vacuum at 260° C. using an extruder type spinning machine, the same procedure as in Example 1 was carried out.

In the multifilaments prepared by conventional techniques in Comparative Examples 5 and 6, on the other hand, though having high strength, they are low in stretchability and cannot serve to produce a belt cord or sewing thread that maintains required tension.

In Comparative example 3, furthermore, the polymer is decomposed when melted under normal pressure, making it impossible to produce a high-strength multifilament. Also, the crystallinity is low, resulting in a disadvantageously low stretchability.

In addition, as seen in Comparative example 1, although an attempt is made to produce a high-strength polyamide 46 multifilament, the use of a draw ratio of more than 1.1 in the final drawing step results in a failure in causing crystallization, leading to poor thermal dimensional stability or poor stretchability. In Comparative example 2, on the other hand, the stretching ratio used in the final drawing step is less than 1.0 and accordingly, yarn breakage occurred frequently, leading to difficulty in sampling a yarn.

TABLE 1

| | Example 1 | Example 2 | Example 3 | Example 4 | Example 5 | Comparative example 1 | Comparative example 2 | Comparative example 3 | Comparative example 4 | Comparative example 5 | Comparative example 6 |
|---|---|---|---|---|---|---|---|---|---|---|---|
| Polymer | polyamide 46 | polyamide 46 | polyamide 46 | polyamide 46 | polyamide 46 | polyamide 46 | polyamide 46 | polyamide 46 | polyamide 46 | polyamide 66 | polyamide 6 |
| Stetching ratio (times) | 4.7 | 4.7 | 4.7 | 4.2 | 4.7 | 4.7 | 4.7 | 4.7 | 4.2 | 5.1 | 5.1 |
| Final stretching ratio (times) | 1.05 | 1.00 | 1.05 | 1.05 | 1.08 | 1.25 | 0.90 | 1.05 | 1.05 | 1.05 | 1.05 |
| Pressure in spinning step | vacuum | vacuum | vacuum | vacuum | vacuum | vacuum | vacuum | normal pressure | vacuum | vacuum | vacuum |

TABLE 2

| | Example 1 | Example 2 | Example 3 | Example 4 | Example 5 | Comparative example 1 | Comparative example 2 | Comparative example 3 | Comparative example 4 | Comparative example 5 | Comparative example 6 |
|---|---|---|---|---|---|---|---|---|---|---|---|
| Fineness (dtex) | 940 | 940 | 1.400 | 470 | 470 | 940 | — | 940 | 235 | 940 | 940 |
| Strength (cN/dtex) | 7.4 | 7.6 | 7.4 | 7.4 | 7.3 | 6.9 | — | 5.7 | 6.8 | 8.6 | 8.1 |
| Elongation at Break (%) | 20.8 | 21.4 | 19.7 | 20.6 | 20.2 | 20.2 | — | 22.2 | 20.4 | 22.1 | 22.0 |
| Sulfuric acid relative viscosity | 3.9 | 3.9 | 3.9 | 3.9 | 3.9 | 3.9 | — | 3.1 | 3.9 | 3.7 | 3.7 |
| Elongation rate after stretching 10 times in room temperature environment (%) | 2.5 | 2.3 | 2.1 | 2.1 | 2.0 | 1.9 | — | 3.8 | 3.3 | 2.7 | 3.3 |
| Difference in elongation rate after stretching 10 times in room temperature environment (%) | 0.57 | 0.53 | 0.49 | 0.51 | 0.48 | 0.47 | — | 0.91 | 0.79 | 0.68 | 0.85 |
| Elongation rate after heat treatment at 120° C. and stretching 10 times (%) | 1.70 | 1.70 | 1.70 | 1.70 | 1.60 | 1.50 | — | 2.10 | 1.90 | 3.10 | 3.40 |
| Difference in elongation rate after heat treatment at 120° C. and stretching 10 times (%) | 0.41 | 0.43 | 0.46 | 0.38 | 0.36 | 0.43 | — | 0.62 | 0.56 | 0.65 | 0.72 |
| Heat shrinkage rate at 120° C. (%) | 1.6 | 1.4 | 1.5 | 1.6 | 1.7 | 2.4 | — | 1.2 | 1.1 | 2.9 | 6.2 |
| Yarn productivity | A | A | A | A | A | B | C | B | B | A | A |

Table 1 shows the production conditions used in Examples 1 to 5 and Comparative examples 1 to 6, and Table 2 shows results of physical properties evaluation of the polyamide 46 multifilaments produced.

As clearly seen in Table 2, our polyamide 46 multifilament has high strength, high thermal dimensional stability, and superior stretchability.

INDUSTRIAL APPLICABILITY

Our polyamide 46 multifilament not only has high strength and hence high durability, but also has high heat resistance, high thermal dimensional stability, and high stretchability, and therefore, when it is used to produce a belt cord, the resulting belt does not require an auto tensioner and serves to reduce the overall cost for a belt drive unit. In addition, the polyamide 46 multifilament is high in stretchability in spite of being high in strength and this feature can be made good use of in providing sewing yarns for clothing such as sports wear.

The invention claimed is:

1. A method for producing a polyamide 46 multifilament having a total fineness of 300 to 2,300 dtex, a strength of 7.0 to 7.6 cN/dtex and an elongation at break of 18% to 30%, a heat shrinkage rate at 120° C. of 0.5% to 2.0%, an elongation rate (E'10) of less than 2.5% after heat treatment at 120° C. for 24 hours and subsequent stretching performed 10 times in a room temperature environment, and a difference (E'10–E'1) between the elongation rate (E'1) of the heat-treated fiber measured after stretching once in a room temperature environment and the elongation rate (E'10) measured after stretching ten times in a room temperature environment is less than 0.60%, wherein the polyamide 46 accounts for 98% by mass or more of the total mass of the polyamide resin excluding the mass of the additives and has a sulfuric acid relative viscosity of 3.0 to 5.0; the method comprising:

melt-spinning polyamide 46, wherein melting of polyamide 46 in the melt-spinning step is performed in a vacuum, and subjecting a resulting undrawn yarn to multi-step drawing, wherein the multi-step drawing contains at least a first step drawing and a final step drawing, with the final step drawing being performed to a draw ratio of 1.00 to 1.10.

* * * * *